US006253952B1

(12) United States Patent
Vial B.

(10) Patent No.: US 6,253,952 B1
(45) Date of Patent: Jul. 3, 2001

(54) CLOSURE MEANS FOR PACKAGING BOXES

(76) Inventor: Ignacio Vial B., Estado 235, of. 511, Santiago (CL)

( * ) Notice: Subject to any disclaimer, the term of this patent is extended or adjusted under 35 U.S.C. 154(b) by 0 days.

(21) Appl. No.: 09/417,087

(22) Filed: Oct. 13, 1999

(51) Int. Cl.[7] ..... B65D 5/64
(52) U.S. Cl. ..... 220/788; 220/324; 229/125.29
(58) Field of Search ..... 220/784, 786, 220/788, 324, 326, 4.21, 4.24; 229/125.29

(56) References Cited

U.S. PATENT DOCUMENTS 4,146,167 * 3/1979 Pascus ..... 229/125.29 X
4,215,796 * 8/1980 Johnston et al. ..... 220/784 X
4,431,113 * 2/1984 Sims, Jr. ..... 220/784 X
4,585,138 * 4/1986 Jonkers ..... 220/784 X
4,960,238 * 10/1990 Lorenz ..... 229/125.29
5,348,549 * 9/1994 Brown et al. ..... 220/788 X
5,390,847 * 2/1995 Young ..... 229/125.29 X
5,427,308 * 6/1995 Swift et al. ..... 229/125.29 X
5,979,691 * 11/1999 Von Holdt ..... 220/788 X

* cited by examiner

*Primary Examiner*—Nathan J. Newhouse
(74) *Attorney, Agent, or Firm*—Shlesinger, Arkwright & Garvey LLP

(57) ABSTRACT

A packaging box has a box with at least a pair of parallel sidewalls having an upper profile with a longitudinal recess that contains two or more fixing tabs and a cover with a cover area of the shape and size of the box and at least two cover flaps having slots to receive the tabs of the box and hold the cover to the box.

1 Claim, 2 Drawing Sheets

CLOSURE MEANS FOR PACKAGING BOXES

BACKGROUND OF THE INVENTION

1. Field of the Invention

The present invention relates to closure means for packaging boxes, wherein said boxes are of the type showing at least two parallel sidewalls.

2. Description of the Related Art

There is a great variety of rigid and semi-rigid, foldable or preformed, disposable or re-usable boxes, which are preferably used to transport products which must be inspected or which require an easy access to them, without breaking the seals in their cover and without using special tools to remove said cover.

A typical application, although not a restrictive one, of the closure means of this invention is them to become incorporated in the boxes of such a type as to contain fruits or similar produce, wherein it is necessary to have an economic, quick and safe closure means on the one hand (that is to say, the cover shall not be removed by accident or when the box is handled), and, on the other hand, it is necessary to remove the cover easily, without damaging it; for example to have access to the contents thereof during customs inspections or to sell the product in selling points.

BRIEF DESCRIPTION OF DRAWINGS

This invention offers closure means meeting the characteristics already mentioned, along with other advantages to be derived from the detailed discussion below, based on a preferred embodiment of the invention to which effect the support of drawings shall be used, where.

DETAILED DESCRIPTION OF INVENTION

Figure 2:
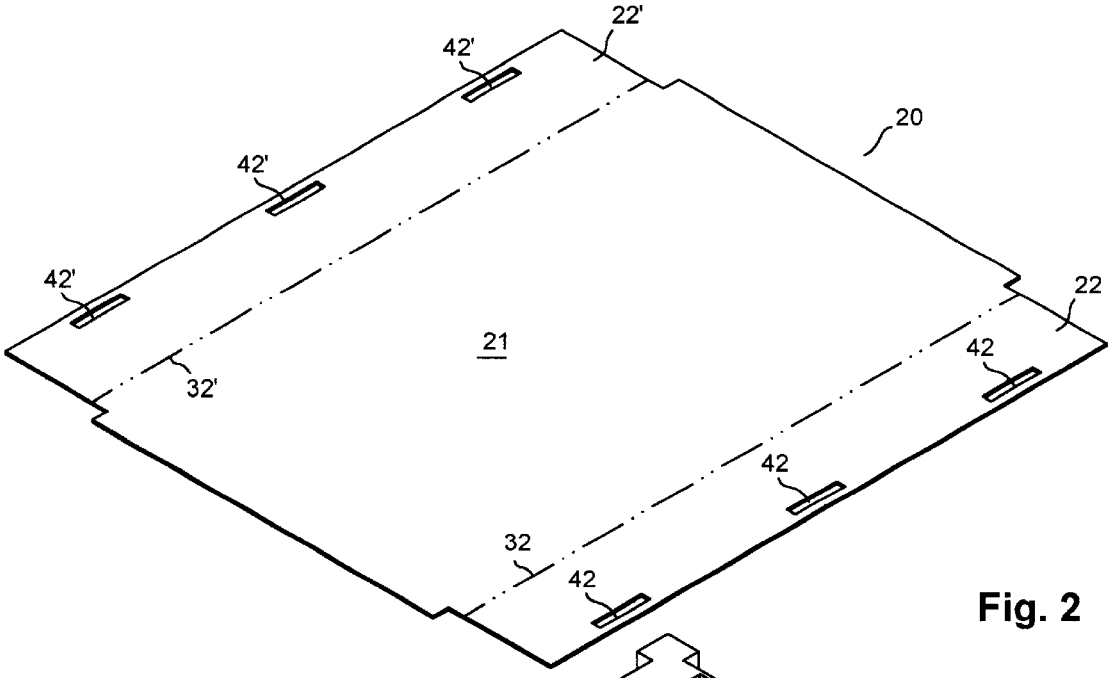
FIG. 2 shows a schematic perspective view of a cover which complements the closure means of this invention.
Figure 1:
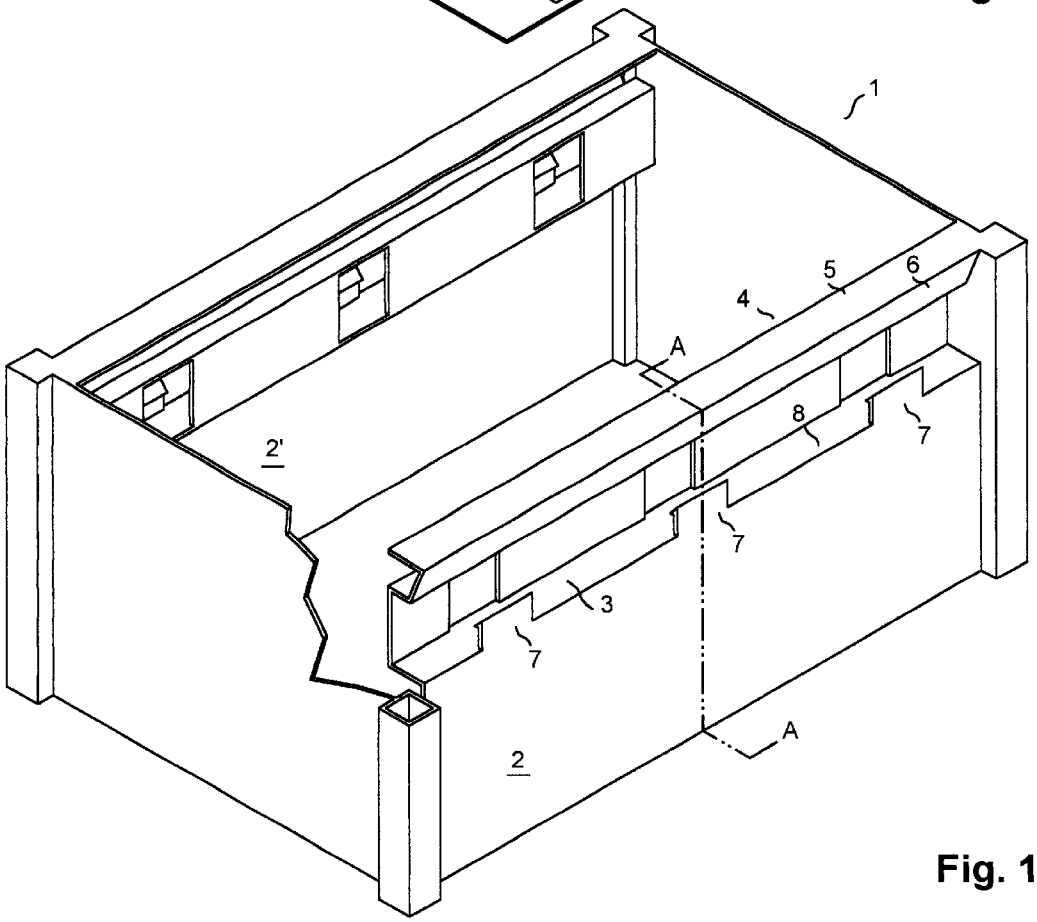
FIG. 1 shows a schematic perspective view of an open box with the closure means of this invention.

As shown in FIG. 1–5, a rigid or semi-rigid box 1 with at least a pair of parallel sidewalls 2 and 2' having an upper profile consisting in a longitudinal recess with a substantially rectangular section 3, which is immediately below the upper edge of the wall 4, formed by a portion of horizontal wall 5 and a portion of substantially vertical wall 6.

The portion of horizontal wall 5 of the upper edge of the wall 4 projects to the inside of the box, while the portion of the substantially vertical wall 6of said upper edge of wall 4 projects to the bottom of the box 1.

The recess of substantially rectangular section 3 tops out in its external lower edge in two or more fixing tabs 7, directed parallel to the corresponding side face (2 and 2') of box 1 and being distributed along said recess 3. The inside upper edge of the fixing tab 7 has a longitudinal rib 8 with its section in the form of wedge, so that its sharp end directs upwards.

Cover 20 which supplements the closure means of this invention is made up of a laminar substantially rigid material, such as cardboard, polypropylene, polyethylene or other synthetic laminar materials, whether smooth or corrugated, the latter being the preferred one. The cover 20 comprises a cover area 21 of a shape and size similar to the upper outermost area of the box 1. The box 20 also comprises at least two cover flaps, 22 and 22' provided in opposing edges of the cover area 21, matching the upper edges of the walls 2 and 2' of box 1. These cover flaps 22 and 22' have a width which is substantially equal to the distance existing between the upper edge of the corresponding side wall 2 (or 2') of box 1 and the lower outermost edge of the recess 3. The frontier lines 32 and 32' between the cover area 21 and the corresponding cover flaps 22 and 22' consist in weakening lines formed whether by a pre-cutting feature or by reducing the thickness in the cover in order to make folding easier. Each of the cover flaps, 22 and 22', has at least so many rectangular slots 42 as fixing tabs 7 the corresponding longitudinal recess of the substantially rectangular section 3 of box 1 have, wherein these rectangular slots 42 are geometrically supplementary to the dimensions and separations of said fixing tabs 7.

Figure 3:
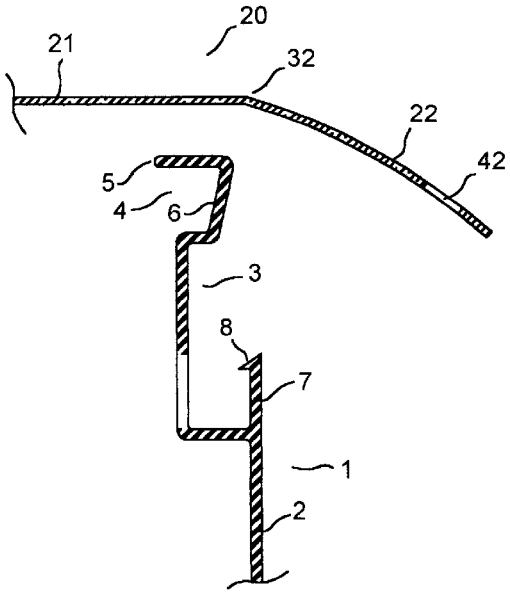
FIG. 3 is a partial cross-section along A—A line of FIG. 1, where a corresponding portion of the cover is shown before placing it in the box.
Figure 4:
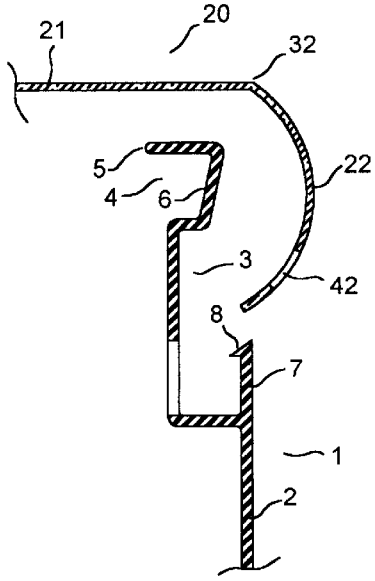
FIG. 4 is a similar view to FIG. 3, with the cover portion in the initial stage of placement in the box.
Figure 5:
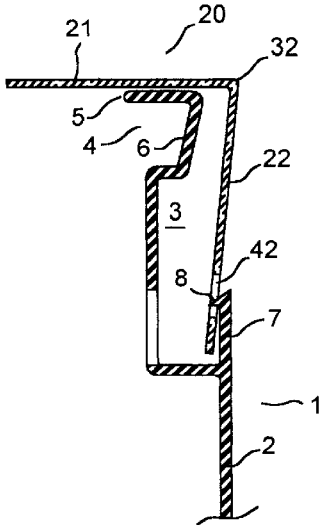
FIG. 5 is a similar view to FIG. 3 with the cover portion in the final stage of placement in the box.

As shown in FIGS. 3–5, and in order to bring about the closure of the box 1 with the cover 21, the latter is approached over the box 1 with its flaps 22 and 22' slightly bent down and in such a way that a concavity is produced (as shown in FIG. 4) and so that its lower edges face the upper edge of the fixing tab 7, in which moment the manual strain produced by said concavity, is released, through which—and due to the elasticity of the material—said flaps 22 and 22' slipped down and inside the corresponding longitudinal recess of a substantially rectangular section 3 of box 1 , so that said flaps 22 and 22' become retained by the wedge-shaped rib 8 of the fixing tab 7, matching the corresponding slots 42. These flaps 22 and 22' remained housed between the inside wall of the recess 3 and the corresponding fixing tabs 7.

In order to release the cover 20 of box 1 without damages, it is necessary to push each flap 22 and 22' in the spaces existing between two fixing tabs 7, and, simultaneously, to exert pressure upwards (for example by simple rubbing) until pulling the slots 42 out of position from the wedge-shaped ribs 8.

In addition to the aforementioned features, the closure means according to the present invention act as limiting means of the box distortion due to the pressure that can be exerted by the contents of the box. This effect is produced, because any force exerted on the flaps 22 and 22' in a normal direction outward of the side walls 2 and 2' will cause said flaps to be more fastened against the wedge-shaped ribs 8, thus making the accidental release of the cover 20 from the box 1 difficult.

Figure 6:
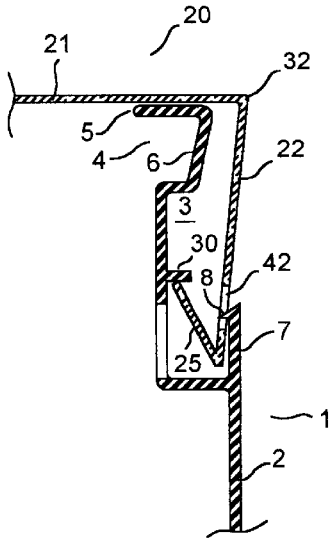
FIG. 6 is a similar view to FIG. 5 corresponding to another embodiment of the invention.

According to another embodiment of the invention, and as shown in FIG. 6, the cover 20 also comprises, in addition to the elements defined in relation to the preferred embodiment, the corresponding butt flaps 25 and 25' attached as terminals in the ends of the cover flaps 22, 22'. On the other hand, the vertical bottom wall of the substantially rectangular section recess 3 has a horizontal or butt rib 30. To install the cover 20 in the box 1, the butt flaps 25, 25' are folded inwards forming a "V" section with the cover flaps 22, 22' respectively, and when the cover flaps 22, 22' finally fit the substantially rectangular section recess 3, the terminal ends of the butt flaps 25, 25' become limited in their vertical displacement by the corresponding horizontal butt ribs 30.

Certain obvious generalizations may be considered already included in the present invention. One kind of this type of obvious generalizations or modifications may consist in replacing the substantially vertical wall 6 with one or more horizontal ribs, which can be considered as the result of making a number of parallel, horizontal slots in said substantially vertical wall. Another kind of obvious generalization is related to the materials to be used in the present invention, which shall not be limited to those already mentioned, any available material being able to be used, which meets the mechanical features of stiffness necessary for the operation of the invention. Even another obvious generalization in the present invention can consist in making up the fixing tab or tabs 7 with a certain flexibility degree in order to make the opening of the box easier.

What I claim is:

1. A packaging box, comprising:

a) a container having an open top and at least a pair of parallel side walls having upper profiles;

b) each of said profiles including a horizontal wall, a vertical wall extending downwardly from said horizontal wall, a longitudinal recess of substantially rectangular section located immediately below said vertical wall;

c) said recess including an outside lower edge having at least two fixing tabs vertically disposed at said outside lower edge, said fixing tabs being oriented parallel to said parallel side walls;

d) a longitudinal rib formed in an upper inside edge of each fixing tab, each rib having a wedge-shaped section with a sharp end oriented upwards;

e) a cover for said container including a cover area to enclose said open top and having at least two cover flaps provided in opposing edges having a width substantially equal to the distance between an upper edge of a corresponding side wall and a lower outermost edge of said recess;

g) said cover including weakening lines formed between said cover area and corresponding cover flaps;

h) each of said cover flaps including a corresponding number of rectangular slots as said fixing tabs, each slot being configured to receive the corresponding rib when said cover flaps are inserted in corresponding recesses.

* * * * *